US005511780A

United States Patent [19]

Vadersen

[11] Patent Number: 5,511,780

[45] Date of Patent: Apr. 30, 1996

[54] GOLF CLUB HOSEL

[76] Inventor: Ernie Vadersen, 13000 Sawgrass Village Cir., Suite 30, Ponte Vedra Beach, Fla. 32082

[21] Appl. No.: 498,604

[22] Filed: Jul. 6, 1995

[51] Int. Cl.[6] ..... A63B 53/02

[52] U.S. Cl. ..... 473/309; 473/323; 473/328

[58] Field of Search ..... 273/167 E, 80.1, 273/80.2, 80.3, 80.4, 80.5, 80.6, 80.7, 80.8, 80.9, 80 B, 80 R, 186.1, 187.4, 164.1, 167 J; D21/214–220

[56] References Cited

U.S. PATENT DOCUMENTS

| | | | |
|---|---|---|---|
| 1,396,470 | 11/1921 | Taylor | 273/167 E |
| 1,528,017 | 3/1925 | Gammeter | 273/167 E |
| 1,550,647 | 8/1925 | Mattern | 273/80.4 |
| 1,787,415 | 12/1930 | Washington | 273/167 E |
| 2,007,976 | 7/1935 | Kraeuter | 273/80.2 |
| 2,088,095 | 7/1937 | Sargent | 273/167 E |
| 3,020,048 | 2/1962 | Carroll | 273/167 G |
| 3,947,041 | 3/1976 | Barber | 273/167 G |
| 4,809,983 | 3/1989 | Langert | 273/80.2 |
| 5,120,061 | 6/1992 | Tsuchida | 273/80.2 |
| 5,230,510 | 7/1993 | Duclos | 273/80.2 |

*Primary Examiner*—Sebastiano Passaniti
*Attorney, Agent, or Firm*—Thomas C. Saitta

[57] ABSTRACT

A golf club hosel comprising three segments is disclosed, the upper segment being circular in cross-section and adapted to receive a golf club shaft, a tapered middle segment having a circular cross-section diminishing in diameter from top to bottom, and an elliptical in cross-section lower segment adapted to join the hosel to the club head.

9 Claims, 1 Drawing Sheet

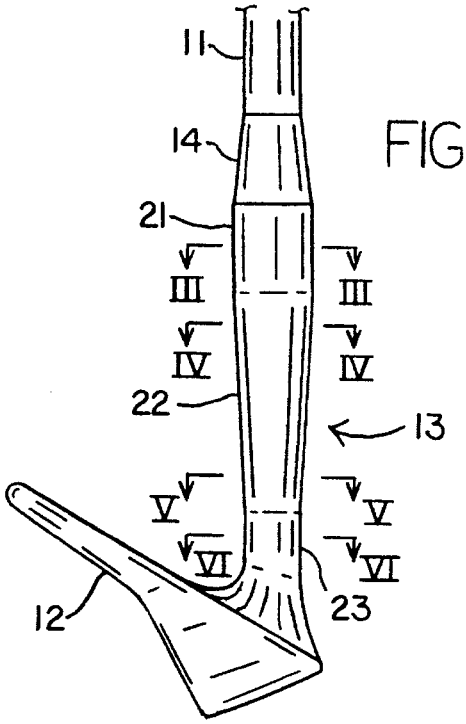
FIG 1
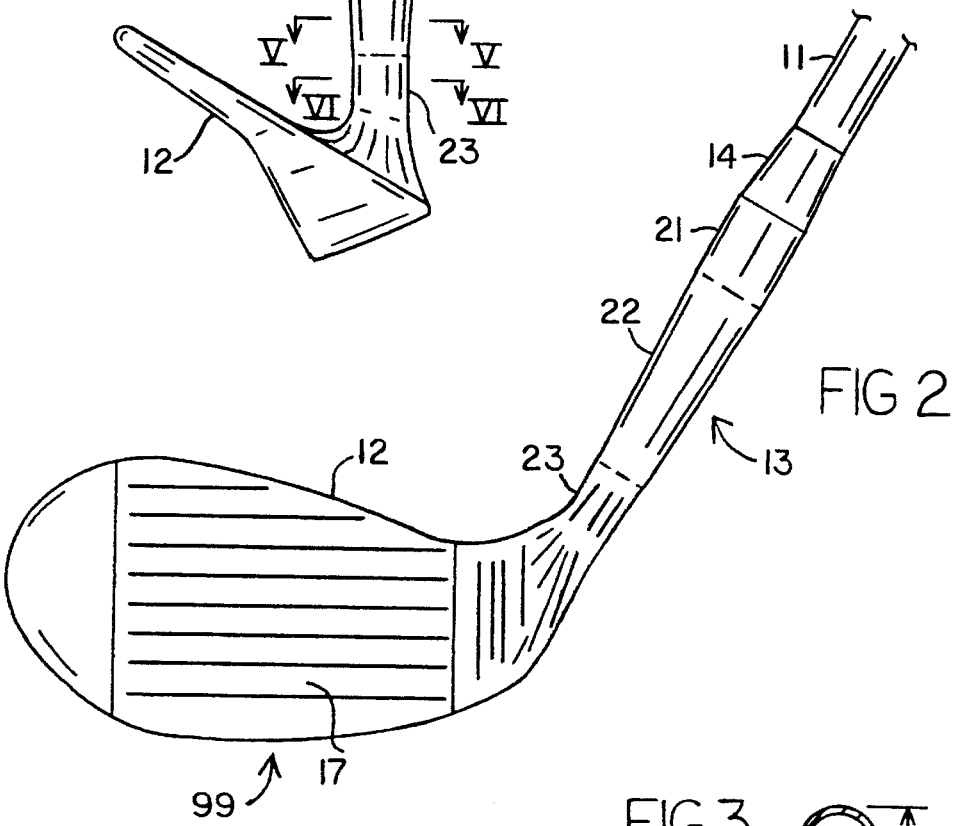
FIG 2
FIG 3
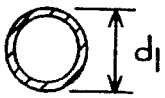
FIG 4
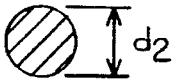
FIG 5
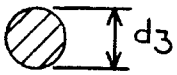
FIG 6 —
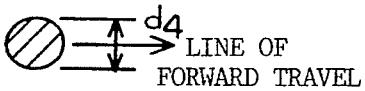

GOLF CLUB HOSEL

BACKGROUND OF THE INVENTION

This invention relates generally to the field of golf club hosels, the transitional member joining the golf club shaft to the heel end of the golf club head. More particularly, the invention relates to hosels used with lofted, bladed golf clubs, referred to as irons and wedges, and in particular relates to hosels having non-traditional cross-sectional shapes directed at reducing drag and bull-whipping encountered in sand or high rough.

In golf club construction, the hosel is the extended portion of the club head which terminates in a tubular opening to receive the cylindrical end of the golf club shaft. The receiving end of the hosel and the opening for the circular in cross-section golf club shaft are correspondingly circular, and the traditional construction for hosels continues this circular cross-section down through the body of the hosel to the base of the hosel, where the cross-sectional shape changes to accommodate the transition of the hosel into the heel end of the club head.

Golf club irons and especially wedges are often used to strike a golf ball which is situated in a hazard such as a sand trap or the area of the course known as the rough. These hazards present difficulty in the execution of a successful golf shot because the normal swing and travel of the golf club is impeded by sand or tall grass, which are encountered by the club head prior to striking the golf ball. When the club head and hosel encounter either sand or tall grass, the increased resistance or drag causes the club head to twist and deviate from its intended path prior to its striking the golf ball. It is desirable therefore to design a golf club iron or wedge which minimizes the resistance effects of the sand or grass. Since the hosel is not directly involved in striking the golf ball, alteration to the traditional hosel design can be affected without dramatically altering the club head itself.

One such attempt to address this problem is taught in U.S. Pat. No. 5,230,510 to Duclos, which illustrates a hosel having a generally triangular cross-sectional configuration with its apex facing forward in the line of travel to reduce the frontal surface exposed to the sand or grass. Additionally Duclos teaches raising the connection point between the hosel and the club face. This later adjustment requires alteration of the full club head, since altering the conjunction affects the balance and striking performance of the club. The triangular cross-sectional configuration of the Duclos hosel is found only in the lowermost transition portion of the hosel and he does not address the drag problems encountered by the mid and upper portion of the hosel body.

It is an object of this invention to provide an improved hosel construction in golf club irons and wedges, the improvement minimizing the problem of drag and resistance encountered when striking golf balls in sand or high grass. It is a further object to provide such a hosel construction which addresses this problem over the majority of the body of the hosel. It is a further object to provide such a hosel which comprises three distinct sections of differing cross-sectional configuration—a first segment circular in cross-section for receiving the club shaft, a tapered second circular in cross-section segment reducing the overall diameter of the hosel, and a third segment where the cross-sectional shape of the hosel is changed from circular to oval.

SUMMARY OF THE INVENTION

The invention is an improved hosel construction for lofted, bladed golf clubs, such as irons or wedges, which reduces the drag and twisting effects encountered when the club is used to strike a golf ball lying is sand or tall grass. The hosel comprises an upper segment, a middle segment and a lower segment. The upper segment is the golf club shaft receiving member and comprises an annular tube with an inner diameter sized to correspond to the outer diameter of the insert portion of the golf club shaft. The middle segment of the hosel comprises a tapered body which reduces the diameter of the circular cross-section from the upper end of the middle segment to the lower end of the middle segment. The lower segment of the hosel is configured such that the shape of the cross-section quickly transitions from circular to oval, with the narrowest aspect of the oval being oriented to the line of travel of the club. The oval cross-sectional configuration is then transitioned into the heel end of the club head. In this manner the drag resistance encountered by the hosel in sand or tall grass is greatly reduced because of the combined effects of the reduction in overall hosel size, the transition from large diameter to small diameter and the transition from circular to oval cross-section.

BRIEF DESCRIPTION OF THE DRAWINGS

FIG. 1 is a side view of the invention, showing the toe end of the club head.

FIG. 2 is a front view of the invention, showing the face and front aspect of the club head.

FIG. 3 is a cross-section taken along line II—II of FIG. 1, showing the upper hosel portion.

FIG. 4 is a cross-section taken along line III—III of FIG. 1, showing the upper end of the middle hosel portion.

FIG. 5 is a cross-section taken along line IV—IV of FIG. 1, showing the lower end of the middle hosel portion.

FIG. 6 is a cross-section taken along line V—V of FIG. 1, showing the lower hosel portion and indicating the direction of travel of the club.

DETAILED DESCRIPTION OF THE INVENTION

With reference to the drawings, the invention will now be described in detail with regard to the best mode and preferred embodiment. The invention comprises an improved golf club hosel construction, the hosel being the transitional member joining the golf club head to the golf club shaft, for use on lofted clubs such as irons and wedges. As shown in FIGS. 1 and 2, hosel 13 is formed as an integral component of golf club head 12, the hosel 13 being the extension rising from the heel end 16 of the club head 12. The hosel 13 is constructed to securely receive the end of the golf club shaft 11 within a shaft receiving recess 15. The abrupt transition from the outer diameter of the golf club shaft 11 to the larger outer diameter $d_1$ of the hosel 13 is typically covered by a tapering sleeve member 14.

Hosel 13 is comprised of three segments, an upper segment 21, a middle segment 22 and a lower segment 23. The upper segment 21 is adjacent the golf club shaft 11 and the lower segment 23 is adjacent the club head 12. As shown in FIG. 3, the upper segment 21 comprises a shaft receiving recess 15 which is annular in cross-section. The shaft receiving recess 15 is sized to matingly correspond to the outer diameter of the circular in cross-section club shaft 11, and the club shaft 11 is joined to the hosel 13 by inserting the club shaft 11 into the shaft receiving recess 15 and securing it using known techniques. The outside of the upper segment 21 is circular in cross-section, having an outer diameter designated as $d_1$, and the upper segment 21 preferably extends only the minimum length required for securely receiving the club shaft 11, approximately thirty percent of the total length of hosel 13. The outer diameter $d_1$ is preferably constant over the entire length of upper segment 21.

Middle segment 22 of hosel 13 is a tapered or conical section which preferably occupies approximately sixty percent of the total length of the hosel 13 and is situated below and adjoining the upper segment 21. Middle segment 22 is circular in cross-section at any point along its length. As shown in FIGS. 4 and 5, the cross-sectional diameter of the middle segment 22 diminishes in the downward direction from the junction with the upper segment 21 to the junction with the lower segment 23. A cross-sectional diameter $d_2$ taken just below the junction with upper segment 21 will be slightly smaller than diameter $d_1$of upper segment 21, while a cross-sectional diameter $d_3$ taken just above the junction with lower segment 23 will be proportionately smaller than both $d_1$ and $d_2$. This reduction in diameter reduces the amount of surface area on the front side of the hosel 13, the front side being taken as the side presented along the line of forward travel of the club during the swing, thus reducing the amount of material present to contact tall grass or sand. The cross-sectional diameter of the middle segment 22 is preferably reduced to the minimum diameter which does not negatively affect the performance of the club.

The lower segment 23 is positioned beneath and adjoined to the middle segment 22, connecting the middle segment 22 to the heel 16 of the club head 12. The lower segment 23 is preferably approximately ten percent of the total length of hosel 13. The lower segment 23 quickly transitions the cross-sectional configuration of hosel 13 from the circular configuration of middle segment 22 to an oval or elliptical configuration as shown in FIG. 6. The majority of the lower segment 23 has the elliptical configuration, with the bottom of lower segment 23 flaring to join the heel end 16 of golf club head 12. The lower segment 23 is oriented relative to the line of forward travel of the golf club when it is swung to strike a golf ball such that the short axis diameter $d_4$ of the ellipse is perpendicular to the line of travel. Defined in another manner, a golf club head 12 can be said to have a front aspect 99, which is when the face 17 is presented square to the ball's intended path of travel, i.e., the front aspect 99 is the alignment where the face 17 is perpendicular to the intended path of travel. The short axis diameter $d_4$ of the ellipse or oval can thus also be said to be perpendicular to the front aspect 99 of the club head 12. This transition from circular cross-section to elliptical cross-section means that the lower segment 23 of the hosel 13 presents an even more reduced front face to sand and tall grass relative to the front face of the middle segment 22, without sacrificing structural integrity in the hosel 13 or diminishing club performance.

The hosel 13 as described has a reduced front face over approximately 70 percent of its length, greatly reducing the amount of drag and resistance encountered when the club is swung through sand or tall grass. Additionally, the reduction in material and corresponding weight in the middle segment 22 and lower segment 23 of the hosel 13 allows a club designer to relocate this weight to various locations on the club head 12 to positively affect club performance without altering the overall weight of the club.

It is understood that equivalents and substitutions may be obvious to those skilled in the art, so the true scope and definition of the invention is to be as set forth in the following claims.

I claim:

1. In a golf club comprising a club head, a club shaft and a hosel connecting said club head to said club shaft, the improvement comprising a hosel comprising an upper segment adjoined to a middle segment adjoined to a lower segment;

said upper segment being circular in cross-section and adapted to receive the golf club shaft;

said middle segment being tapered and circular in cross-section, whereby the diameter of said middle segment adjacent said upper segment is greater than the diameter of said middle segment adjacent said lower segment;

and said lower segment being elliptical in cross-section.

2. The device of claim 1, where said golf club has a preferred line of forward travel and where said lower segment has a short axis diameter which is perpendicular to said line of forward travel.

3. The device of claim 1, where said golf club head has a front aspect and where said lower segment has a short axis diameter oriented perpendicular to said front aspect.

4. The device of claim 1, where said upper segment comprises approximately thirty percent of the total length of said hosel.

5. The device of claim 1, where said middle segment comprises approximately sixty percent of the total length of said hosel.

6. The device of claim 1, where said lower segment comprises approximately ten percent of the total length of said hosel.

7. The device of claim 4, where said middle segment comprises approximately sixty percent of the total length of said hosel.

8. The device of claim 4, where said lower segment comprises approximately ten percent of the total length of said hosel.

9. The device of claim 7, where said lower segment comprises approximately ten percent of the total length of said hosel.

* * * * *